US005107607A

United States Patent [19]

Mason

[11] Patent Number: 5,107,607

[45] Date of Patent: Apr. 28, 1992

[54] KILN FOR DRYING LUMBER

[76] Inventor: Howard C. Mason, 4421 S.W. Coast, Lincoln City, Oreg. 97367

[21] Appl. No.: 468,002

[22] Filed: Jan. 22, 1990

[51] Int. Cl.[5] ..... F26B 21/06

[52] U.S. Cl. ..... 34/191; 34/16.5; 34/218

[58] Field of Search ..... 34/191, 16.5, 223, 219, 34/218, 213, 214, 232, 233, 218

[56] References Cited

U.S. PATENT DOCUMENTS

| | | | |
|---|---|---|---|
| 635,572 | 10/1899 | Moore | 34/232 |
| 1,044,230 | 11/1912 | Newhall et al. | 34/213 |
| 1,435,094 | 11/1922 | Warren et al. | 34/214 |
| 1,543,344 | 6/1925 | Thelen | 34/213 |
| 1,745,375 | 2/1930 | Mueller | 34/213 |
| 1,954,239 | 4/1934 | Doherty | 34/213 |
| 1,955,374 | 4/1934 | Cobb et al. | 34/191 |
| 1,968,874 | 8/1934 | Cobb | 34/191 |
| 2,932,905 | 4/1960 | Hanley | 34/213 |
| 3,262,216 | 7/1966 | Dugger, Sr. | 34/77 |
| 3,386,183 | 6/1968 | Reynolds | 34/218 |
| 3,477,139 | 11/1969 | Hildebrand | 34/191 |
| 4,098,008 | 7/1978 | Schuette et al. | 34/191 |
| 4,176,464 | 12/1979 | Randolph | 34/191 |
| 4,603,491 | 8/1986 | Hengle et al. | 34/191 |
| 4,653,202 | 3/1987 | More et al. | 34/218 |
| 4,862,599 | 9/1989 | Brunner | 34/191 |

*Primary Examiner*—Henry A. Bennet
*Assistant Examiner*—Denise Gromada
*Attorney, Agent, or Firm*—Kolisch, Hartwell, Dickinson, McCormack & Heuser

[57] ABSTRACT

A kiln for drying material such as lumber. A primary centrally located support structure supporting a roof which extends outwardly to opposite sides of the support structure. The support structure is hollow, and an air-circulating system uses this hollowness as a passage for circulating air.

9 Claims, 3 Drawing Sheets

KILN FOR DRYING LUMBER

This invention relates to a kiln usable, for instance, in the drying of material such as lumber.

Lumber after being cut from a log contains a considerable amount of moisture. This moisture includes moisture held within the cellular structure of the wood as well as free moisture which is distributed throughout the wood without actually being held by cellular structure. Total moisture content of the wood will vary, of course, depending upon the species. By way of example, and with a soft wood such as Douglas Fir, a typical overall moisture content of freshly cut wood might be in the range of 40 to 60 percent based on the dry weight of the wood. To prepare lumber from this wood for sale requires that the overall moisture content be reduced, for instance, to about 15 percent, a level which more closely approximates equilibrium with normal atmospheric conditions.

Kilns currently available in North America, for the most part, are designed for the rapid seasoning or drying of lumber in large volumes. To obtain proper drying, the entire kiln must be filled with the same or similar species of material, and the material must have the same or similar characteristics, such as thickness and width. This type of equipment does not lend itself for use with small amounts of material, and where the nature of the material handled varies, as between hardwood and softwood.

When wood is dried too rapidly, case hardening of the wood results, with the wood then cracking and in other ways being deleteriously effected. It is important, therefore, for optimum drying of wood, that there be a uniform rate of moisture absorption by air as it passes over all the wood in a kiln, and that the moisture that is removed from wood surfaces be at a rate which approximates the rate at which moisture within the wood rises to the wood surface. Obviously accurate control of temperature and humidity within the kiln is required, and movement of air within the kiln must be such that it is substantially uniform throughout all regions containing the material to be dried. For economic reasons, the kiln should be insulated and air tight, to eliminate heat loss. A kiln represents a capital investment to the lumber producer, and the provision of a kiln which is relatively economically constructed has obvious advantages.

A general object of this invention, therefore, is to provide a kiln with various features which enable accurate control of temperature and humidity of air circulated therein.

Another general object is the provision of a kiln with structural features contributing to a low cost for the kiln.

More specifically, a feature and object of the invention is the provision of a kiln with a twin air flow design providing for relatively uniform air circulation at reactively high velocities and contributing to accurate control of internal kiln conditions.

Another object is to provide a kiln which has a prefabricated modular design, contributing to reduced initial cost in erecting the kiln.

Yet a further object is to provide a kiln which is readily loaded and unloaded from opposite sides, contributing to reduced "down" time in the kiln.

Other features include a reversible fan system producing air flow, a truss-type of construction for roof sections, and a block, i.e., tile or concrete block, construction for walls between units functioning as a fire barrier.

These and other objects and advantages are attained by the invention, which is more fully described hereinbelow in conjunction with the accompanying drawings, wherein.

Figure 1:
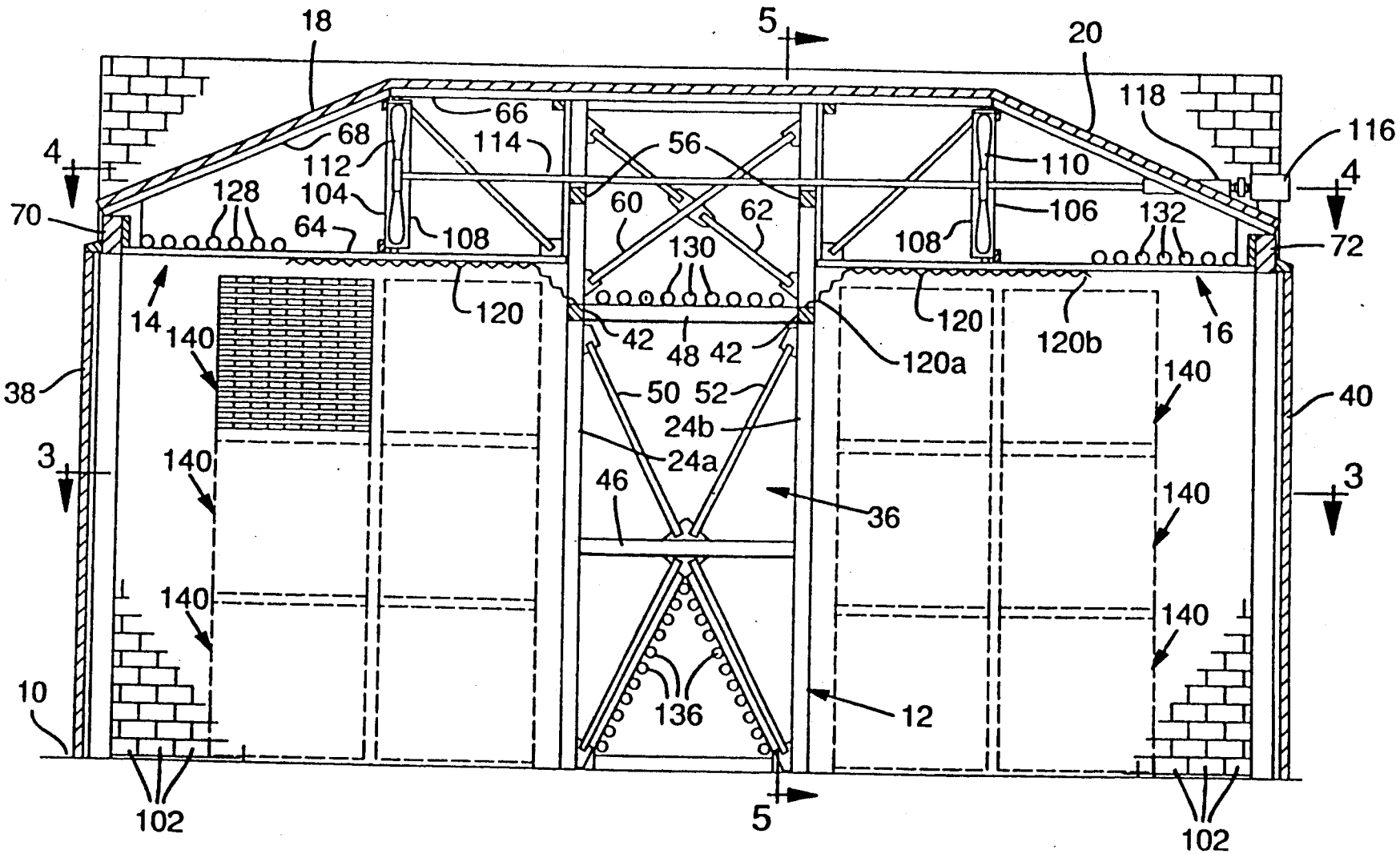
FIG. 1 is a, cross-section, somewhat simplified of a kiln constructed according to the invention.

Referring now to the drawings, the kiln illustrated stands on a finished floor indicated at 10 in FIG. 1. Extending up from this floor 10 is what is referenced to herein as an upstanding primary support structure given the general reference numeral 12. This structure is substantially midway between opposite sides of the kiln as the kiln is illustrated in FIG. 1. Mounted on the structure and extending to the left of the structure in FIG. 1 is a truss framework or structure 14. Also mounted on this structure adjacent its top and extending to the right is another truss framework or structure 16. These structures support a roof including roof portion or section 18 supported by structure 14 and roof portion or section 20 supported by structure 16.

Figure 3:
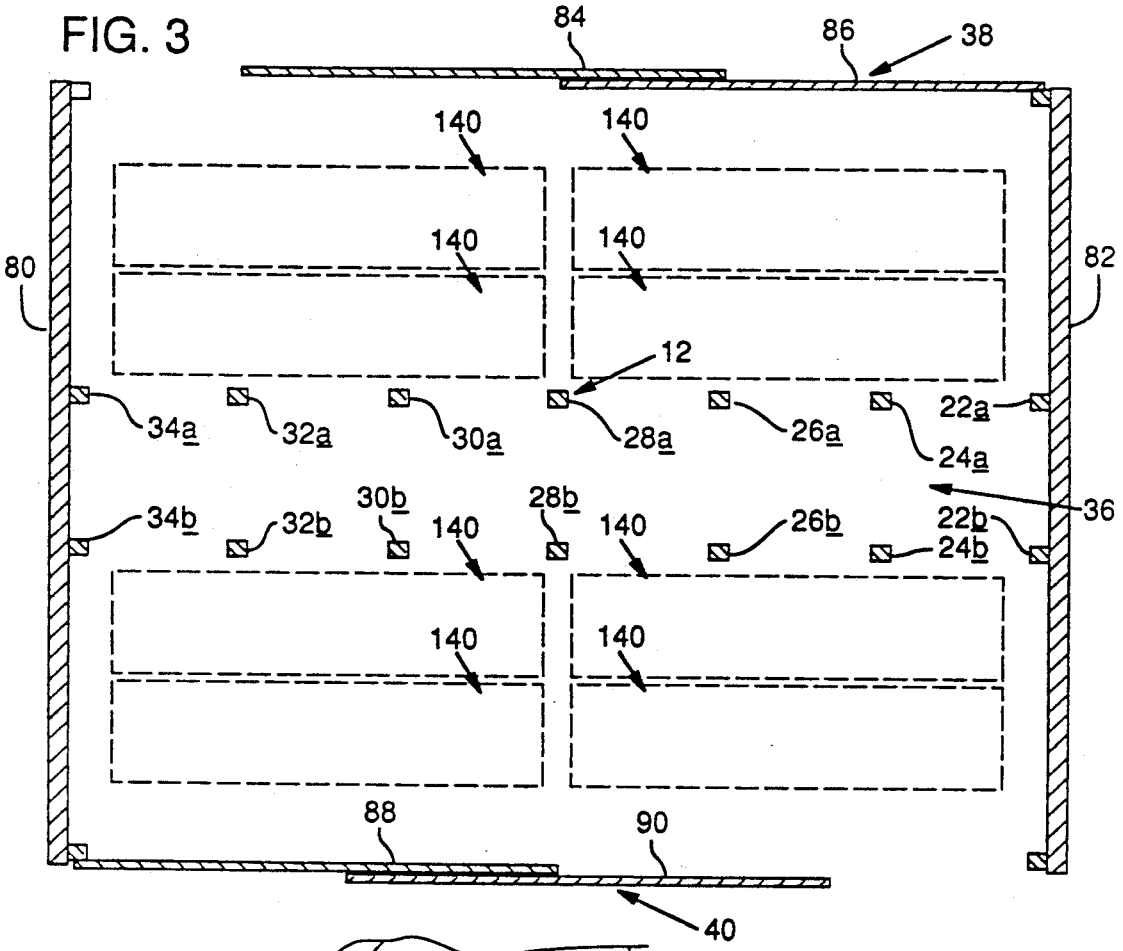
FIG. 3 is a cross-sectional plan view, taken generally along line 3—3 in FIG. 1.
Figure 5:
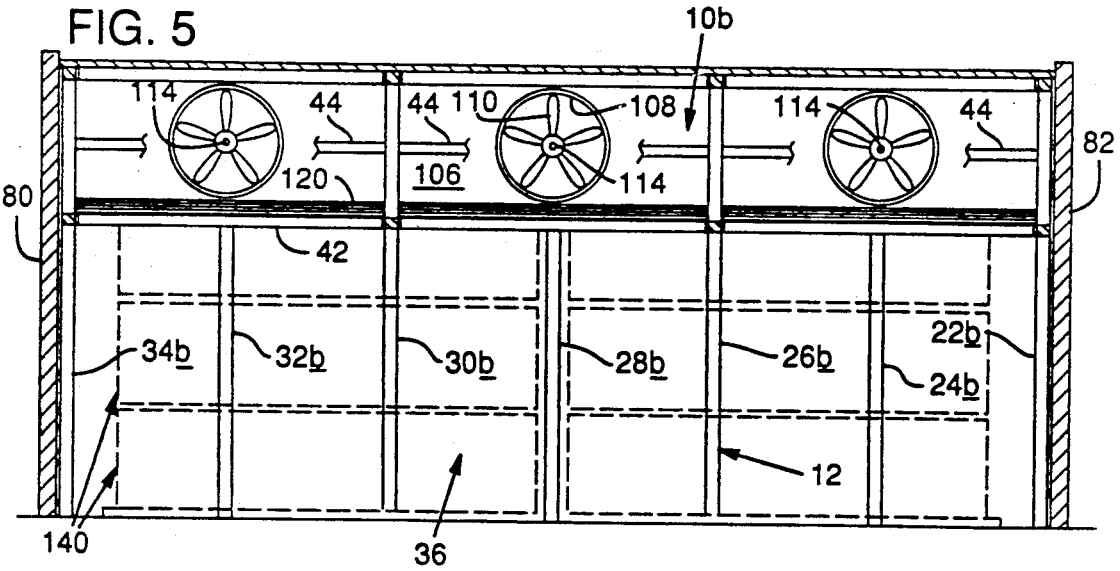
FIG. 5 is a cross-sectional view taken generally along the line 5—5 in FIG. 1.

Considering more in detail primary support structure 12, and referring to FIGS. 1, 3, and 5, such includes plural uprights designated at 22*a* and *b*, 24*a* and *b*, 26*a* and *b*, 28*a* and *b*, 30*a* and *b*, 32*a* and *b*, and 34*a* and *b* as such are illustrated in FIG. 3. These are suitably anchored to the floor and delineate a hollow space or bay 36 extending the length of the kiln between opposite sides 38 and 40 as such appear in FIG. 3. These uprights are interconnected and made rigid by structural members such as longitudinals 42, cross pieces 46, and diagonal struts 50, 52. The structure described not only provides the primary support for the building, i.e., its roof and door structure (to be described), but also in bay or hollow space 36 provides a passage used in the circulation of air during operation of the kiln.

Certain uprights, as exemplified by uprights 22*b*, 26*b*, 30*b*, and 34*b* shown in FIG. 5 extend upwardly from longitudinal 42 adjacent the top of the kiln. These are interconnected (see FIG. 1) as by longitudinal 56 and diagonal struts 60, 62 to provide a rigid hollow upward extremity to primary support structure 12.

Truss support structure 14 includes horizontals 64 with inner ends suitably connected to the primary support structure and extending laterally outwardly therefrom. The truss structure further includes, at spaced intervals along the length of the structure, roof support members 66, 68 interconnected at adjacent ends, and with member 66 having its inner end suitably connected to the primary support structure. Outer ends of horizontals 64 and roof support members 68 are interconnected by a lintel beam 70.

Truss structure 16 projecting out to the other side of primary support structure 12 has a similar construction. Horizontal and roof support members corresponding to members 64 and 68 in structure 16 have outer ends joined by a lintel beam 72.

Earlier. sides 38, 40 were described as being located on opposite sides of the primary support structure as viewed in FIG. 3. A pair of doors 84, 86 is provided for closing off side 38, and a similar pair of doors 88, 90 is provided for closing off side 40.

Figure 2:
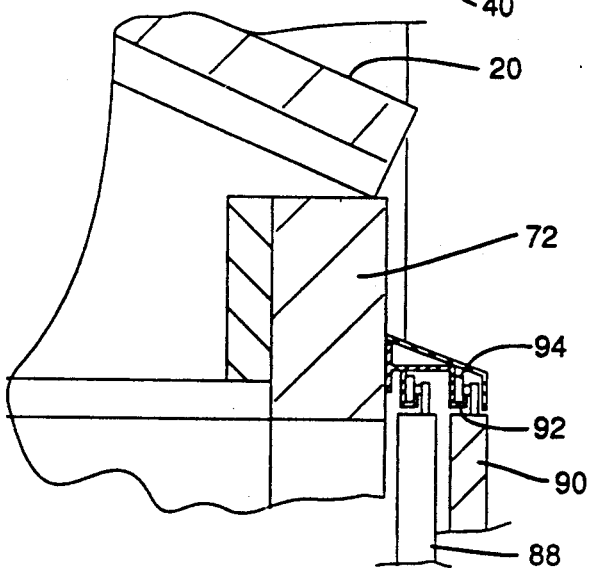
FIG. 2 illustrates, on a somewhat larger scale, how a side door in the kiln may be suspended.

The doors closing off a side of a kiln are movably suspended from a lintel beam. This may be done by providing a track which extends along and is secured to the lintel beam and rollers guided in the track which have a door suspended therefrom. This is illustrated in FIG. 2 where track 92 secured to lintel beam 72 guides roller such as roller 94 which rollably supports door 90 depending from these rollers. By providing doors suspended as described, it is an easy matter to close off a side through adjustment of the doors, or to open up a side by moving the doors to a position where one is essentially entirely in back of another. This provides a wide access opening to the kiln interior. The kiln has no supporting framework extending from the floor to the roof structure offering obstruction to entry to the kiln interior from a side.

To conserve heat, the doors preferably are insulated.

The kiln being rectangular in shape has another pair of sides extending normal to sides 38, 40 and these are closed off by walls 80, 82.

Walls 80, 82 preferably are composed of blocks, such as the tile or concrete blocks partially indicated at 102 in FIG. 1. The walls are essentially non-load bearing, and as can be seen in FIG. 1, project upwardly on a side of the kiln to an elevation which is slightly above the highest part of the roof in the kiln. With the walls of a nonflammable material and having the extent described, they provide an effective fire barrier separating the kiln from, for instance, a like kiln disposed therebeside.

The roof of the kiln including roof sections 18. 20 and that section of the roof that covers the primary support structure may be made of insulated roof panels, again for the purpose of conserving heat.

Figure 4:
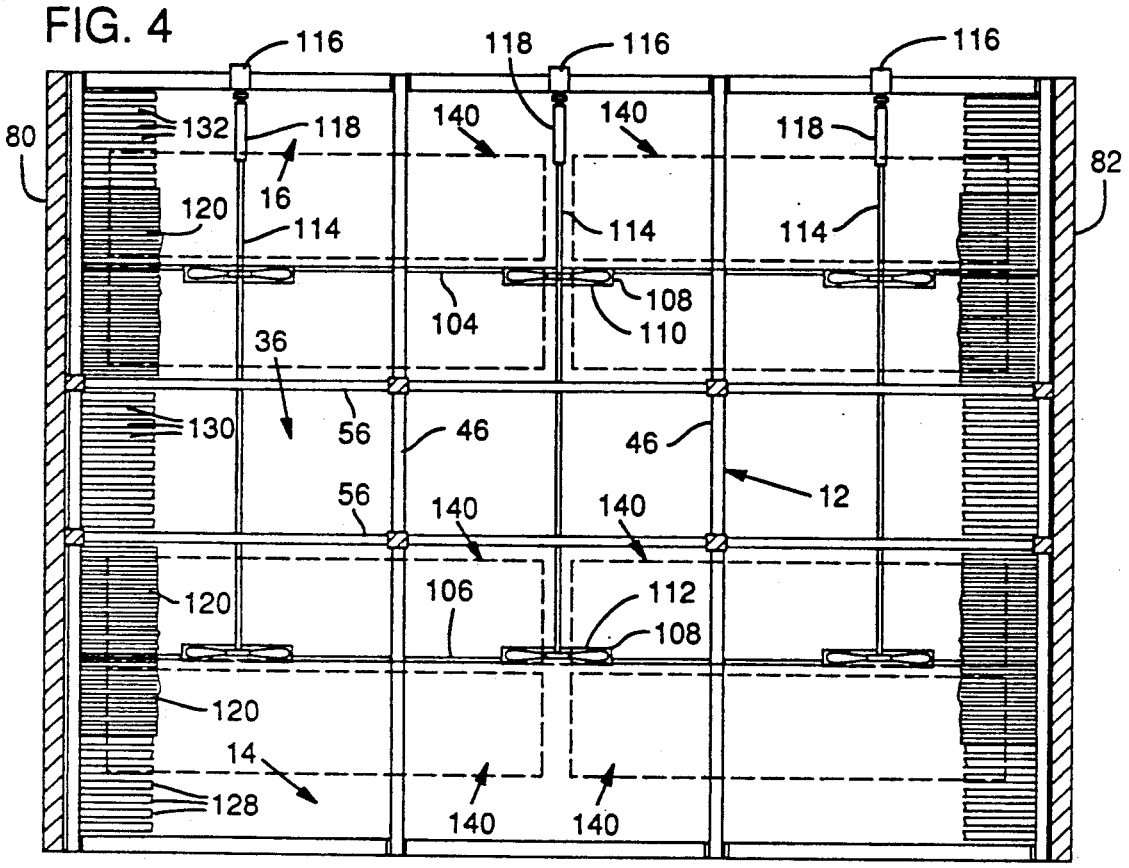
FIG. 4 is a cross-sectional plan view of the kiln, at a higher elevation and approximately along the line 4—4 in FIG. 1.

Supported within each truss structure and paralleling a side of the kiln is a fan wall, shown in connection with structure 14 at 104 and in connection with structure 16 at 106 (see FIG. 1). The fan walls have circular apertures 108 provided therein (see FIG. 5). Each aperture in one fan wall is aligned with a corresponding aperture in the other fan wall (see FIG. 4).

Mounted within aligned apertures are a pair of fans, as exemplified by fans 110, 112 shown in FIG. 1. These fans are mounted on a common shaft 114. The shaft is rotatably supported in a position extending across the top of the kiln. Connected to the shaft for rotating it is a reversible motor 116. The motor is shown located on the outside of the roof structure. Where the shaft 114 extends through the roof structure a suitable seal 118 is provided. In the particular embodiment of the invention shown, there are three sets of fans, each like the one just described.

Associated with each truss structure is a baffle such as baffle 120 shown for structure 16. The baffle may take the form of a corrugated sheet having the length of the kiln, and extending from margin 120*a* to margin 120*b*.

Shown at 128, 130, and 132 are sets of heating surfaces. These may be heated in any suitable manner as, for instance, electrically or by steam heated means. The sets of heating surfaces provide a means for heating the air circulated within the kiln.

Adjacent the base of the kiln and extending along the interior of bay 36 are sets of tubes forming a condenser 136. These tubes are suitably cooled as by circulating a coolant. Moist air traveling onto the condenser has moisture removed therefrom through condensation on the condenser.

Describing how the kiln may be used, packages of lumber, as represented by the package outlines indicated at 140, are lodged within the kiln on each side of the primary support structure which forms the center of the kiln. Lift trucks may be used in the loading of the kiln with these packages, as such trucks are easily driven into the kiln with the doors open. Rows of packages are formed inside the kiln with inner most rows extending adjacent the central support structure. As is conventional, the lumber tiers in the respective packages are separated from each other to provide for air flow therebetween as by using conventional stickers, etc.

With the kiln loaded with lumber packages, the doors are closed and circulated air brought to the proper temperature through control of the heat provided by heating surfaces 128 through 132.

As already discussed, a pair of fans or blowers are mounted on a common drive shaft, and in the embodiment illustrated, three of such pairs have been provided. The fans are configured so that with rotation of a shaft in one direction, the fans push air outwardly, with such air then traveling outwardly and around the outer margin of a baffle and thence downwardly in the kiln. The air then travels through the tiers of lumber in the packages to collect in the central bay provided within the interior of the primary support structure. The air then travels upwardly to be drawn into the fans. The circulation pattern described is then repeated. With the shaft rotated in the opposite direction, the air is pushed by the fans toward the center of the kiln and such travels downwardly over the inner margins of the baffles to enter the bay provided within the center support structure. Such air, then travels outwardly through the lumber to return to the fans by traveling around the outer margins of the baffles. Ordinarily, it is contemplated that periodically the direction of air flow will be reversed, as this tends to produce the most uniform type of drying in the kiln.

Moisture is removed by the condenser within the kiln. The kiln need not rely upon the replacement of air within the kiln with ambient air outside the kiln to maintain humidity control. This feature contributes to accuracy in temperature and humidity control.

At the end of a drying cycle, it is relatively easily to unload the material from the kiln. The doors are easily rolled aside to provide access to the kiln interior. Down time in the kiln may be kept to a minimum.

While particular embodiment of the invention has been described, it should be apparent the modifications and variations are possible without departing from the invention.

It is claimed and desired to secure by Letters Patent:

1. In a kiln having a roof and a first pair of opposite sides:

an elongate upstanding primary support structure for the roof substantially paralleling said first pair of opposite sides and located intermediate said first pair of opposite sides of the kiln, said roof being disposed over the primary support structure, the roof including a portion extending from the support structure to one of said opposite sides and another portion extending from the primary support structure to the other of said opposite sides, a truss framework for each roof portion supporting the roof portion, said truss framework projecting from and being mounted on said primary support structure, and plural doors and mountings for the doors suspending said doors from the roof portions, said doors forming said first pair of opposite sides for the kiln and being shiftable upon said mountings between positions opening and closing said first pair of sides of the kiln, said truss framework for a roof portion enabling the primary support structure to provide support for the doors and mountings.

2. The kiln of claim 1, wherein a set of doors closes off one of said first pair of sides of the kiln, and another set of doors closes of the other of said first pair of sides of the kiln.

3. The kiln of claim 1, wherein a set of doors closes off one of said first pair of sides of the kiln, another set of doors closes off the other of said first pair of sides of the kiln, and non-combustible walls close off a second pair of opposite kiln sides, said second pair of kiln sides being disposed normal to said first pair of opposite kiln sides.

4. The kiln of claim 3, wherein said second pair of kiln sides are composed of blocks of non-flammable material and provide a fire barrier.

5. The kiln of claim 1, wherein the kiln has a second pair of opposite sides extending normal to said first pair of sides, and wherein said primary support structure is a hollow structure extending a major portion of the distance between said second pair of sides, and which further includes air-circulating means circulating air in a path which path extends at least partially through said hollow structure.

6. The kiln of claim 5, wherein said air-circulating means comprises a reversible blower means supported by a truss framework.

7. The kiln of claim 5, wherein said air-circulating means comprises one reversible blower disposed toward one of said sides of said first pair of sides from the primary support structure and supported by a truss framework, another reversible blower disposed toward the other of said sides of said first pair of sides from the primary support structure and supported by a truss framework, and means for operating the blowers whereby they either push air inwardly toward each other with such air then flowing down and into said hollow structure, or push air outwardly away from each other with air being pulled upwardly into the hollow structure, the kiln including passages for circulating air opening to the interior of the kiln adjacent the tops of the doors closing off said first pair of sides of the kiln.

8. In a kiln:

means forming an enclosed drying chamber having opposed sides and a top, means intermediate said opposed sides defining a hollow air-circulating space, said space extending a major portion of the length of said opposed sides and further extending from adjacent the floor to adjacent said top of said chamber, air-circulating means operable to circulate air in a path which extends at least partially through said air-circulating space and along each of said opposed sides, said air-circulating means comprising one reversible blower disposed toward one of said opposed sides of the kiln from said air-circulating space, and another reversible blower disposed toward the other of said opposed sides of said kiln from the air-circulating space, and means for operating the blowers whereby they either push air toward each other and thence downwardly into the air-circulating space, or push air outwardly from each other while pulling air inwardly from said air-circulating space, and doors closing off said sides of the kiln, said air-circulating means including passages for circulating air opening to said drying chamber adjacent said opposed sides and above said doors.

9. The kiln of claim 8, wherein the means defining a hollow air-circulating space comprises primary support structure extending from the base of the kiln to adjacent the top of the kiln, and wherein the top of the chamber comprises a roof section extending from the primary support structure to one side of the kiln and another roof section extending from the primary support structure to the other side of the kiln, and which further includes a truss structure supporting each roof section projecting from and mounted on said primary support structure.

* * * * *